US006837136B2

(12) United States Patent
Rodriguez

(10) Patent No.: US 6,837,136 B2
(45) Date of Patent: Jan. 4, 2005

(54) COMBINATION PUNCHER

(75) Inventor: Humberto Rodriguez, Wabash, IN (US)

(73) Assignee: Martin Yale Industries, Inc., Wabash, IN (US)

( * ) Notice: Subject to any disclaimer, the term of this patent is extended or adjusted under 35 U.S.C. 154(b) by 0 days.

(21) Appl. No.: 10/453,354

(22) Filed: Jun. 3, 2003

(65) Prior Publication Data

US 2004/0244553 A1 Dec. 9, 2004

(51) Int. Cl.[7] ..... B26F 1/04
(52) U.S. Cl. ..... 83/549; 83/691; 83/167
(58) Field of Search ..... 83/588, 563, 618, 83/167, 691, 687, 549

(56) References Cited

U.S. PATENT DOCUMENTS 1,335,632 A * 3/1920 Zimmer ..... 83/513
2,534,094 A * 12/1950 Yerkes ..... 83/449
3,073,199 A * 1/1963 Yerkes ..... 83/549
3,808,933 A * 5/1974 Buan ..... 83/588
3,944,373 A * 3/1976 Farjon et al. ..... 402/1
4,466,322 A * 8/1984 Mori ..... 83/468
4,688,457 A * 8/1987 Neilsen et al. ..... 83/468
4,724,734 A 2/1988 Hse
5,012,712 A * 5/1991 Nordquist ..... 83/571
5,342,276 A * 8/1994 Fujiwara et al. ..... 483/29
5,974,929 A * 11/1999 Kugel et al. ..... 83/582
6,076,447 A * 6/2000 Damask ..... 83/618

* cited by examiner

*Primary Examiner*—Charles Goodman

(57) ABSTRACT

A hand operated combination two-and-three-hole puncher for making holes in paper and other sheet materials is shown and described.

The two-hole punch assembly and the three-hole punch assembly are fixedly disposed on the common platform either in-line, or at a predetermined angle, to each other in such manner that both punch assemblies share a common punch subassembly and a common foot. The common punch subassembly could be activated using either the press lever frame of the two-hole punch assembly or the press lever frame of the three-hole punch assembly thus enabling the common punch subassembly to punch a hole in the process of the two-hole perforation or the three-hole perforation without the readjustment.

2 Claims, 2 Drawing Sheets

COMBINATION PUNCHER

TECHNICAL FIELD

This invention relates to the hole punching devices, more specifically, the hand-operated hole punchers for paper and other sheet materials.

BACKGROUND OF THE INVENTION

Hand-operated punchers, used to punch holes in paper and other sheet materials such as cardboard, leather, fabric, plastics, and similar materials, are well-known. Punchers are primarily being used to bind these sheets in a binder. There are several different binder standards. The most popular in the US are the three-hole binders where the distance between two adjacent rings is 4.25" and the two-hole binders where the distance between binder rings is 2.75".

Numerous adjustable combination punchers are known to the art where the same punching sets could be used to punch two or three holes at the time. However, all these punchers need to be readjusted in order to switch from a three-hole punch to a two-hole punch, and vice-versa.

In the U.S. Pat. No. 2,534,094, J. A. Yerkes discloses an adjustable paper puncher where 11 removable punch members can be inserted into all or any of the available 11 holes. In this puncher, switching from two to three holes requires a readjustment by pulling and reinserting of the punch members.

In the U.S. Pat. No. 4,688,457, Hildaur L. Neilsen discloses an adjustable paper puncher where each punch set is having a pivoted spacer that can be turned to engage the particular set with a lever. In this puncher, the switching from two to three holes requires a readjustment accomplished by turning the pivoted spacer.

In the U.S. Pat. No. 4,724,734, Park-Son Hse discloses a multipurpose puncher that includes a pair of single-hole stationary puncher assemblies positioned separately on a base, and a movable puncher assembly mounted slidably between these stationary assemblies. This puncher permits to switch from a single-hole punch and a two-hole punch without making any changes to a puncher. But switching from a two-hole to three-hole punch requires a readjustment.

All these combination punchers require a readjustment in order to switch from two-hole punch and three-hole punch. Placing two separate punchers, a two-hole and a three-hole puncher, side-by-side on a common platform has never made much sense because such a combination puncher would have nearly as many components as two separate units and have the same footprint as the total footprint of two punchers.

SUMMARY OF THE INVENTION

An improved combination two-and-three hole puncher is disclosed where the synergy between a two-hole punch assembly and a three-hole punch assembly permits to reduce the number of components and the footprint of the device.

According to the present invention, the two-hole punch assembly and the three-hole punch assembly are fixedly disposed on the common platform either in-line, or at a predetermined angle, to each other in such manner that both punch assemblies share a common punch subassembly and a common foot. The common punch subassembly could be activated using a press lever frame of the two-hole punch assembly or a press lever frame of the three-hole punch assembly. As the result, only four punch subassemblies are required to make both, the two-hole perforation and the three-hole perforation without the need for readjustment.

DRAWINGS REFERENCE NUMERALS

Figure 1:
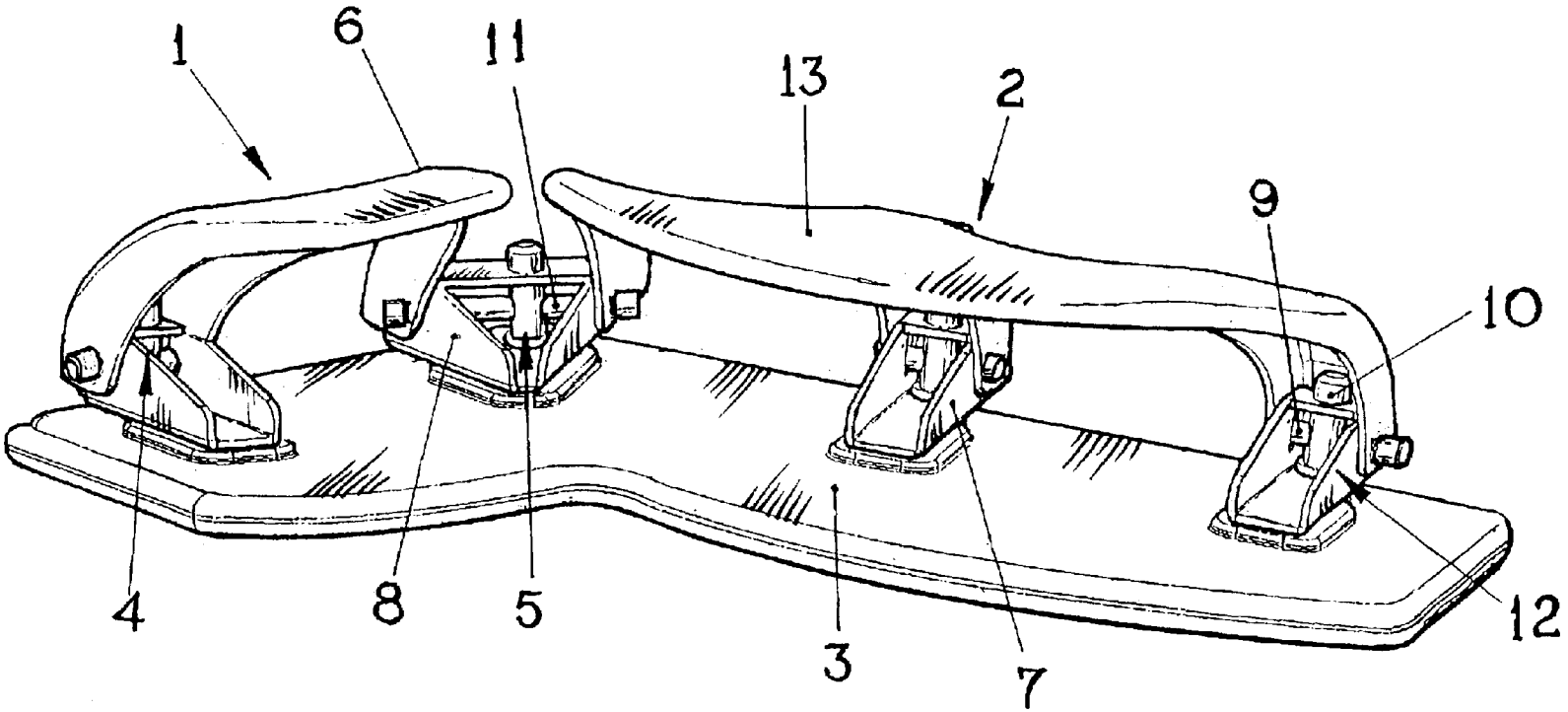
FIG. 1 is a perspective view of the preferred embodiment of the combination two-and-three hole puncher made in accordance with the present invention.

1 two-hole punch assembly
2 three-hole punch assembly
3 common platform
4 punch subassembly unique to the two-hole punch assembly
5 common punch subassembly
6 press lever frame of the two-hole punch assembly
7 foot
8 common foot
9 shaft
10 punch member
11 elongated shaft
12 punch subassembly unique to the three-hole punch assembly
13 press lever frame of the three-hole punch assembly
14 in-line two-hole punch assembly
15 in-line three-hole punch assembly
16 streamlined common platform
17 modified common punch subassembly
18 modified press lever frame of the two-hole punch assembly
19 modified press lever frame of the three-hole punch assembly

DESCRIPTION OF THE PRESENTLY PREFERRED EMBODIMENT

FIG. 1 shows the preferred embodiment of the combination two-and-three hole puncher made in accordance with the present invention. A two-hole punch assembly 1 and a three-hole punch assembly 2 are fixedly disposed on a common platform 3 at a pre-determined angle to each other. The two-hole punch assembly 1 is comprised of a punch subassembly unique to the two-hole punch assembly 4, a common punch subassembly 5, a press lever frame of the two-hole punch assembly 6, a foot 7, and a common foot 8. The press lever frame of the two-hole punch assembly 6 is pivotably disposed to the foot 7 and the common foot 8. Both feet are fixedly disposed on the common platform 3.

The punch subassembly unique to the two-hole punch assembly 4 is comprised of a shaft 9 and a punch member 10. The common punch subassembly 5 is comprised of an elongated bar 11 and the punch member 10. The punch members 10 are pivotably disposed on the shaft 9 and the elongated shaft 11 respectively. The shaft 9 and the elongated shaft 11 are disposed on the opposite ends of the press lever frame of the two-hole punch assembly 6 congruently to the foot 7 and the common foot 8 respectively. The two punch members 10, drivable by the press lever frame of the two-hole punch assembly 6, provide for the two-hole perforation.

The three-hole punch assembly 2 is comprised of the common punch subassembly 5, two punch subassemblies unique to the three-hole punch assembly 12, a press lever frame of the three-hole punch assembly 13, the two feet 7, and the common foot 8. All three feet are fixedly disposed on the common platform 3. The press lever frame of the three-hole punch assembly 12 is pivotably disposed on the two feet 7 and the common foot 8.

The punch subassemblies unique to the three-hole punch assembly 12, being in this embodiment identical to the punch subassembly unique to the two-hole punch assembly 4, are comprised of the shaft 9 and the punch member 10. The three punch members 10 are pivotably disposed on the two shafts 9 and the elongated shaft 11. The two shafts 9 and the elongated shaft 11 are disposed on the press lever frame of the two-hole punch assembly 6, congruently to the two feet 7 and the common foot 8 respectively. The three punch members 10, drivable by the press lever frame of the three-hole punch assembly 13, provide for the three-hole perforation.

A synergy between the two-hole punch assembly 1 and the three-hole punch assembly 2 is accomplished by both assemblies sharing the common punch subassembly 5, which could be activated by either the press lever frame of the two-hole punch assembly 6 or the press lever frame of the three-hole punch assembly 13. Thus, only four punch subassemblies are required to make both, the two-hole and the three-hole perforations. Furthermore, both, the two-hole punch assembly 1 and the three-hole punch assembly 2 share the common foot 8 and only four feet are required to support both, the press lever frame of the two-hole punch assembly 6 and the press lever frame of the three-hole punch assembly 13. Being compared to the solution where two separate punchers, a two-hole and a three-hole puncher, are disposed side-by-side on a common platform, the proposed solution leads to a substantial reduction in the number of components and complexity of assembling. Reduced as well are the footprint and the overall size of the combination puncher. At the same time, the switching from two-hole punching to three-hole punching and back requires no readjustment.

Figure 2:
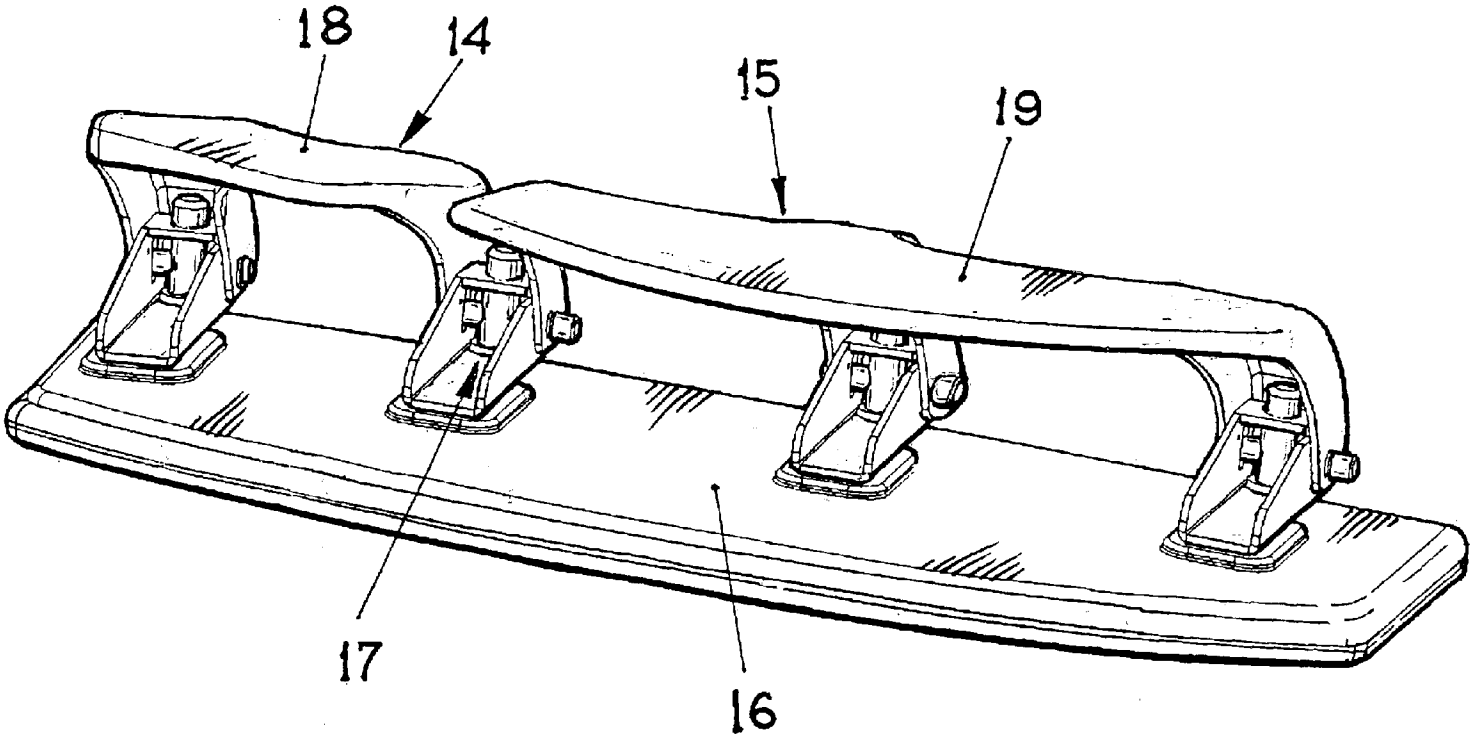
FIG. 2 is a perspective view of another embodiment of the combination two-and-three hole puncher made in accordance with the present invention.

FIG. 2 shows another embodiment of the combination two-and-three hole puncher made in accordance with the present invention. An in-line two-hole punch assembly 14 and an in-line three-hole punch assembly 15 are fixedly disposed on a streamlined common platform 16 in a linear arrangement. As with the preferred embodiment, in this embodiment a modified common punch subassembly 17 is shared by the in-line two-hole punch assembly 14 and the in-line three-hole punch assembly 15, and can be activated either by a modified press lever frame of the two-hole punch assembly 18, or a modified press lever frame of the three-hole punch assembly 19.

A synergy between the in-line two-hole punch assembly 14 and the in-line three-hole punch assembly 15 is accomplished by both assemblies sharing the modified common punch subassembly 17. In addition to all the advantages of the said preferred embodiment, with the current embodiment, the switching from two-hole punching to three-hole punching requires no repositioning of the puncher toward the user.

What is claimed is:

1. A combination two-and-three hole puncher comprising:

a common platform;

a two-hole punch assembly, the two-hole punch assembly fixedly disposed on said common platform;

a three-hole punch assembly, the three-hole punch assembly fixedly disposed on said common platform at a predetermined angle other than 180 degrees to said two-hole punch assembly;

a foot, the foot fixedly disposed on said common platform;

a common foot, the common foot fixedly disposed on said common platform and shared by both said two-hole punch assembly and said three-hole punch assembly;

a press lever frame of the two-hole punch assembly, the press lever frame of the two-hole punch assembly pivotably disposed on said foot and said common foot;

a punch subassembly unique to the two-hole punch assembly drivable only by said press lever frame of the two-hole punch assembly; and a common punch subassembly drivable by said press lever frame of the two-hole punch assembly, the common punch subassembly shared by said two-hole punch assembly and said three-hole punch assembly.

2. A combination two-and-three hole punch assembly comprising:

said common platform;

a two-hole punch assembly, the two-hole punch assembly fixedly disposed on said common platform;

a three-hole punch assembly, the three-hole punch assembly fixedly disposed on said common platform at a predetermined angle other than 180 degrees to said two-hole punch assembly;

two feet fixedly disposed on said common platform;

a common foot, the common foot fixedly disposed on said common platform and shared by both said two-hole punch assembly and said three-hole punch assembly;

a press lever frame of the three-hole punch assembly the press lever frame of the three-hole punch assembly pivotably disposed on said two feet and said common foot;

two punch subassemblies unique to the three-hole punch assembly drivable only by said press lever frame of the three-hole punch assembly;

a common punch subassembly shared by said two-hole punch assembly and said three-hole punch assembly, said common punch subassembly drivable by said press lever frame of the three-hole punch assembly.

* * * * *